US011598602B2

(12) United States Patent
Griggs

(10) Patent No.: US 11,598,602 B2
(45) Date of Patent: Mar. 7, 2023

(54) ARCHERY BOWSTRING WEIGHTS AND RELATED METHOD OF USE

(71) Applicant: Gas Bowstrings, LLC, Clay City, KY (US)

(72) Inventor: Eric J. Griggs, Stanton, KY (US)

(73) Assignee: Gas Bowstrings, LLC, Clay City, KY (US)

( * ) Notice: Subject to any disclaimer, the term of this patent is extended or adjusted under 35 U.S.C. 154(b) by 0 days.

(21) Appl. No.: 17/575,108

(22) Filed: Jan. 13, 2022

(65) Prior Publication Data

US 2022/0252372 A1 Aug. 11, 2022

Related U.S. Application Data

(60) Provisional application No. 63/146,846, filed on Feb. 8, 2021.

(51) Int. Cl.
*F41B 5/14* (2006.01)
*F41B 5/20* (2006.01)

(52) U.S. Cl.
CPC ..... *F41B 5/1411* (2013.01); *F41B 5/1426* (2013.01)

(58) Field of Classification Search
CPC ..... F41B 5/1411; F41B 5/1415
See application file for complete search history.

(56) References Cited

U.S. PATENT DOCUMENTS 2,617,402 A * 11/1952 Roemer ..... F41B 5/14 124/90
2,910,058 A * 10/1959 Bender ..... F41B 5/14 124/91
2,956,560 A * 10/1960 Stockfleth ..... F41B 5/14 124/90
3,340,862 A * 9/1967 Saunders ..... F41B 5/14 124/91
3,756,214 A * 9/1973 Christen ..... F41B 5/1407 473/522
3,756,215 A * 9/1973 Black ..... F41B 5/1415 124/91
5,016,603 A * 5/1991 Tentler ..... F41B 5/14 124/91
8,109,261 B2 2/2012 Grace, Jr.
9,587,902 B2 * 3/2017 McPherson ..... F41B 5/1426
9,933,228 B2 4/2018 McPherson
10,317,164 B2 * 6/2019 Ady ..... F41B 5/1411

OTHER PUBLICATIONS 2006-2007 Lancaster Archery Catalog, p. 158.
2018 GAS Bombs at https://gasbowstrings.com/black-bomb/ downloaded Jan. 28, 2021.

* cited by examiner

*Primary Examiner* — John A Ricci
(74) *Attorney, Agent, or Firm* — Warner Norcross + Judd LLP

(57) ABSTRACT

An archery bowstring weight is provided including a sleeve that is encapsulated and suspended at least partially within an overmolded polymeric body forming an exterior of the bowstring weight. The sleeve can be a metal body, such as a ring, that floats or moves inside the polymeric body when the bowstring vibrates to dampen vibration of the bowstring. The sleeve can be isolated or separated from the bowstring by an inner wall of the polymeric body that is disposed between the bowstring and the sleeve when the weight is installed on the bowstring. The oscillation of the sleeve inside the overmolded polymeric body also can attenuate string oscillation and reduce string noise. A related method is provided.

20 Claims, 4 Drawing Sheets

ARCHERY BOWSTRING WEIGHTS AND RELATED METHOD OF USE

BACKGROUND OF THE INVENTION

The present invention relates archery bows, and more particularly to bowstring weights, commonly referred to as speed nocks.

Archery bows, such as compound bows, typically include a bowstring and a set of cables that transfer energy from the limbs and cams of the bow to the bowstring, and thus to an arrow shot from the bow. Frequently, bowstring weights, referred to as speed nocks, are placed along the bowstring to increase the energy imparted to the arrow by the bow. The weight and location of speed nocks usually are unique to the bowstring and the bows mechanical characteristics, among other things. Many times, different types of bowstrings and bows require custom or precisely calibrated placement of the speed nocks along the bowstring to ensure that the speed nocks function properly, increasing the speed of the arrow shot from the bow.

A common speed nock includes one or more split brass clips, typically of an open "C" shape, that are placed over a bowstring and deformed so that the brass nock fully encircles the bowstring. The brass nocks usually are crimped on the bowstring to place and hold them in a specific location. Installation of the brass nocks typically is performed manually, pneumatically, or with specialized equipment produced for installation of multiple nocks on the bowstring at a time. Where manufacturers recommend a significant amount of weight on a bowstring, installation of multiple brass nocks can be difficult. For example, some advanced cam designs call for ten or more of these brass nocks, equating to 75+ grains, on each end of the bowstring. To install this large number of nocks, an installer must carefully and precisely place each brass nock adjacent the next, and ensure their crimping technique does not alter or move previously placed nocks. In some cases, machined brass "stacks" can be used instead of placing individual brass nocks, however, these can be expensive to machine and even more difficult to install without specialized equipment. The cost of both multi-stacked, individual brass nocks, or machined brass stacks also can be high when using so many on each bowstring. In addition, safety of the consumer can sometimes become an issue if one or more brass nocks become dislodged during a potential dry-fire of the bow, or in cases where a nock is not properly installed, during regular shooting of the bow.

Another issue with current brass nocks or machined brass stacks is that while they can increase bow speed, they do nothing functionally to reduce string noise or vibration. Even with brass speed nocks or brass stacks installed on the string, users and shops typically will add rubber silencers or dampeners, such as cat whiskers, monkey tails, wishbones, etc., to reduce string noise and vibration.

Accordingly, there remains room for improvement in the field of bowstring weights to reduce string vibration and noise.

SUMMARY OF THE INVENTION

An archery bowstring weight is provided including a sleeve that is encapsulated and suspended at least partially within a polymeric body forming an exterior of the bowstring weight.

In one embodiment, the sleeve can be a metal body, such as a ring, that floats or moves inside the polymeric body when the bowstring vibrates, to dampen vibration of the bowstring. The polymeric body can be overmolded over the metal body.

In another embodiment, the sleeve can be isolated or separated from the bowstring by an inner wall of the polymeric body that is disposed between the bowstring and the sleeve when the weight is installed. The oscillation of the sleeve inside the polymeric body also can eliminate string noise.

In still another embodiment, the sleeve can include a first inner diameter. The polymeric body can include a second inner diameter. The first inner diameter can be greater than the second inner diameter which can be greater that a diameter of the bowstring. With this construction, an inner wall of the polymeric body can be disposed inward from an interior surface of the sleeve, such that the inner wall is between the interior surface and the bowstring.

In even another embodiment, the sleeve can form a continuous, metal ring around the bowstring when the bowstring weight is applied to the bowstring. The metal ring, however, can be buffered from and not contacting the bowstring due to the inner wall of the overmolded polymeric body, which can directly engage and contact the bowstring.

In a further embodiment, the sleeve can be constructed from metal, such as brass. The sleeve can weigh between 5 grains and 100 grains, inclusive. The inner diameter of the sleeve can be between 0.125 inches and 0.5 inches, inclusive. The polymeric body can include an inner diameter that is smaller than the bowstring diameter, but that expands when the bowstring weight is applied to the bowstring to allow the bowstring to fit inside a bore bounded by the inner wall.

In still a further embodiment, a method is provided. The method can include providing an archery bow comprising a first limb and a second limb, with a bowstring having a bowstring diameter located between the first limb and the second limb; providing a bowstring weight comprising a sleeve encapsulated within an overmolded polymeric body; and installing the bowstring weight on the bowstring so that the polymeric body directly engages the bowstring, with the sleeve suspended around the bowstring but separated from the bowstring by an interior wall of the polymeric body.

In yet a further embodiment, the method can include oscillating or moving the sleeve inside the polymeric body when the bowstring vibrates to dampen vibration of the bowstring and/or attenuate string noise or buzz when the bowstring vibrates.

The current embodiments of the bowstring weight can provide benefits not previously realized with conventional brass clip speed nocks. The bowstring weight can provide increased and/or centralized weight over a smaller area than currently available speed nocks. The bowstring weight can maximize efficiency and speed out of a variety of cam designs, and can add additional engineering possibilities in the field of archery bow cam design. The bowstring weight can reduce bowstring vibration and noise. Where the string weight, such as the sleeve, is fully captured in the overmolded polymeric body, the weight can move and oscillate inside of the polymeric body when the bow is fired, dampening the vibration of the string. The oscillation of the weight or sleeve inside the polymeric body also can reduce or eliminate string noise, commonly referred to "buzz".

Further, the current embodiments of the bowstring weight can offer ease of installation without having to crimp the weight onto a bowstring. With the use of a bow press, these can be installed by the consumer on existing bowstrings. At an archery pro-shop or store, the bowstring weight can be installed during a new bowstring installation or added to an existing bowstring. The bowstring weights can provide custom bowstring application for bowstring manufacturers to use these in place of current speed nocks, stacks or other rubber sleeves. In addition, OEM archery bow manufacturers can add the bowstring weights at the conclusion of building the bowstring or before installing strings on the bow during the assembly process.

The current embodiments of the bowstring weight can provide increased safety with no potential for the weight to become dislodged from the bowstring. When the sleeve is a machined or solid tube, or continuous ring, void of a seam or need for crimping, the weight cannot become dislodged or fly off the string. This can provide a safer alternative for the string manufacturer, bow manufacturer, retail seller and consumer.

The current embodiments of the bowstring weight can reduce the amount of separate and independent units on the string. For example, where the bowstring weight and the bowstring vibration reduction being contained in a single unit, installation and use of separate and independent units for both weight and rubber vibration can be eliminated. Further, because this is contained in a single unit, there can be a potential material cost savings and installation time-savings.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENTS

Figure 1:
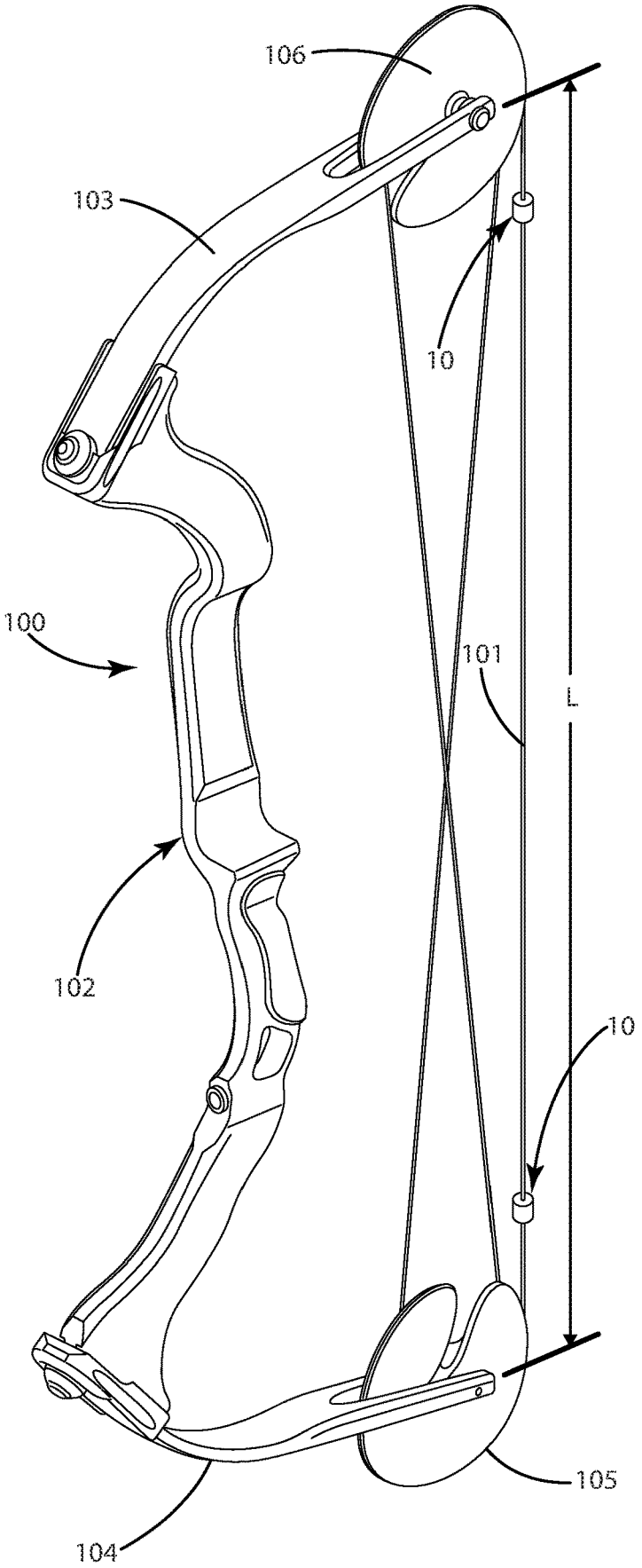
FIG. 1 is a perspective view of the bowstring weight of a current embodiment installed on a bowstring of a compound archery bow.
Figure 2:
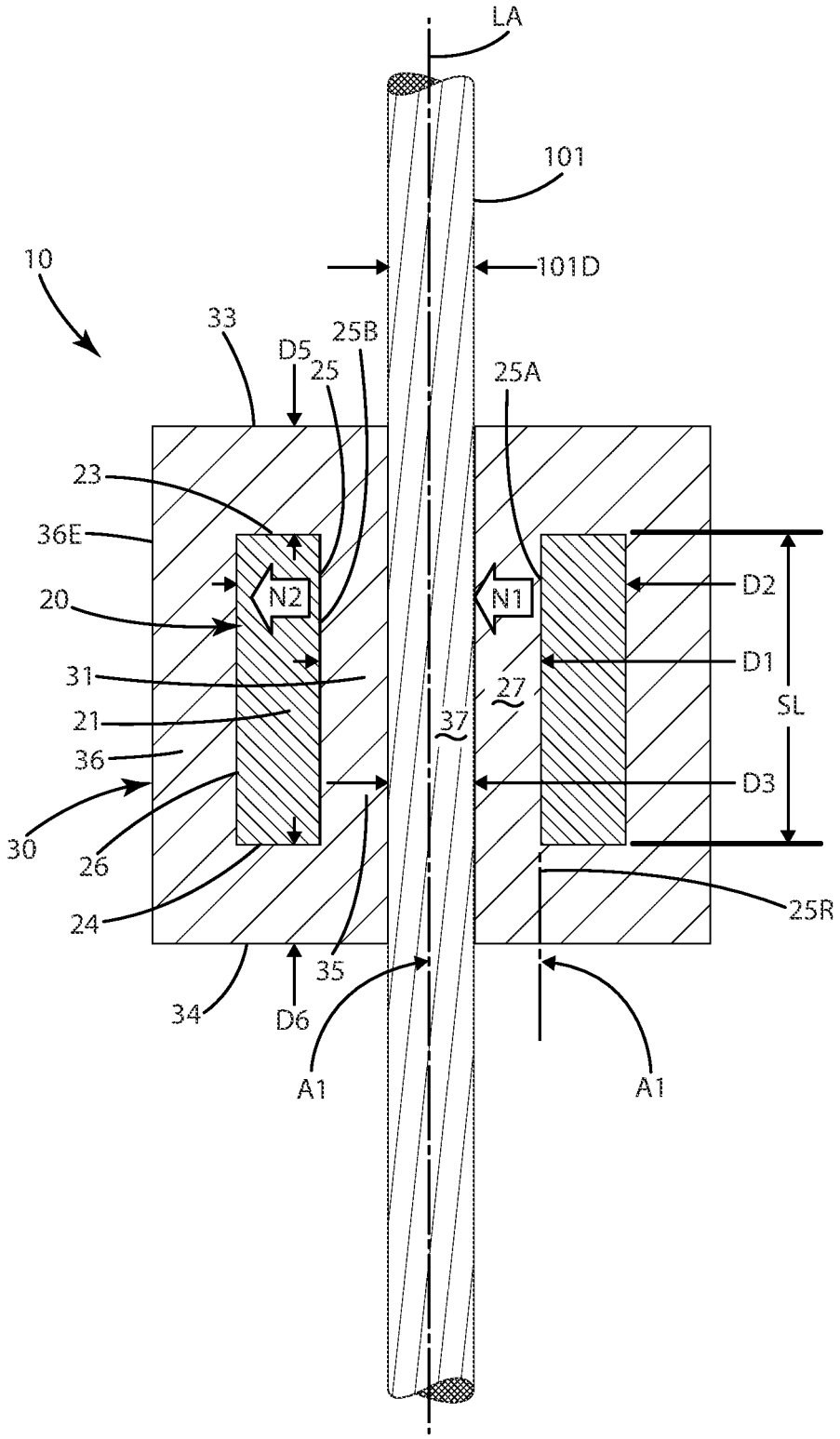
FIG. 2 is a section view of the bowstring weight taken along line II-II of FIG. 1.
Figure 3:
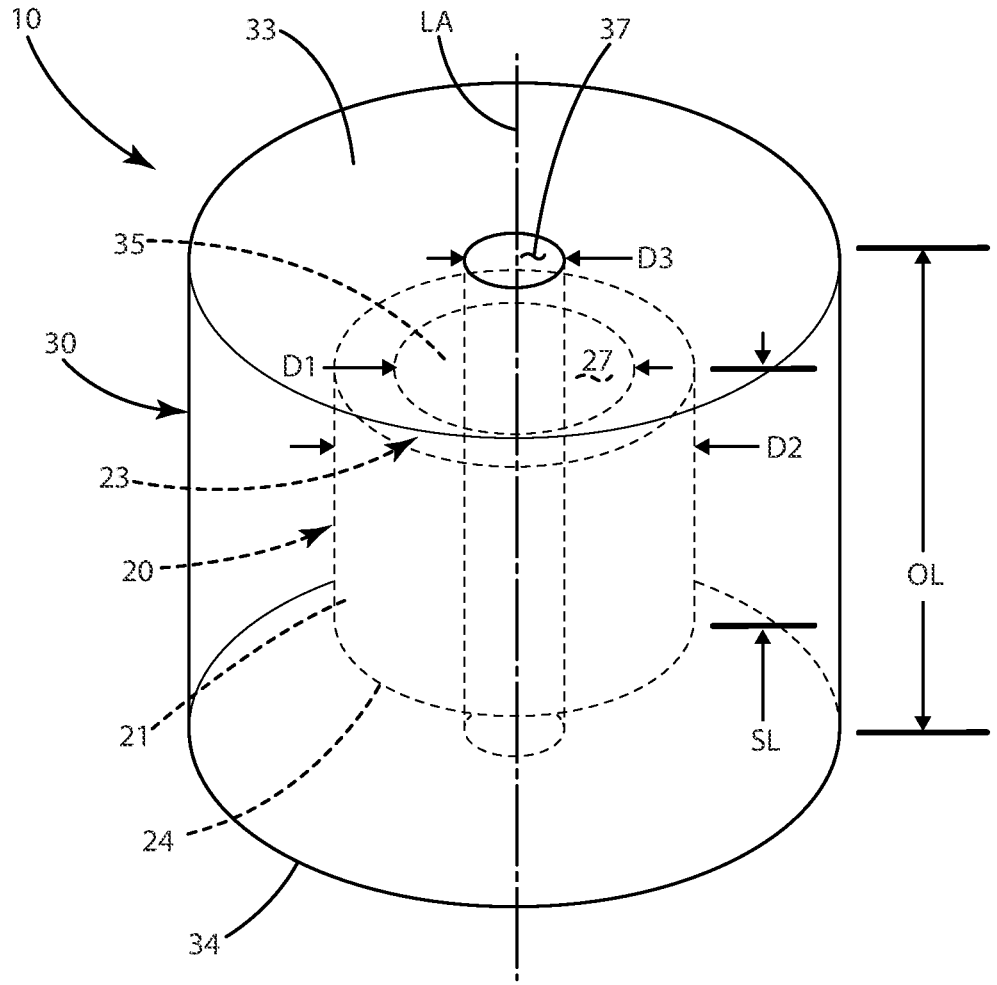
FIG. 3 is a perspective view of the bowstring weight removed from the bowstring.

A current embodiment of the bowstring weight is shown in FIGS. 1-3 and generally designated 10. There, a pair of the bowstring weights 10 is installed on a compound archery bow. In particular, a first bowstring weight can be installed directly on a bowstring 101 within an upper one quarter of the length L of the bowstring, while a second bowstring weight can be installed directly on the bowstring 101 within a lower one quarter of the length L of the bowstring. The precise location of each bowstring weight 10 can be selected depending on the design of the cam or of the bow. The bow includes a riser 102 joined with first 103 and second 104 limbs. These limbs further include cams 105 and 106 that rotate and that engage the bowstring to transmit mechanical force from the limbs to the bowstring during respective draw and shot cycles when the bow 100 is used by an archer.

Although the current embodiment is described in connection with a single cam bow, the current embodiment and its features are suited for use with other types of pulley systems and other compound archery bows, as well as recurve bows, longbows, crossbows and other archery systems including a bowstring. As used herein, a "cam" refers to a cam, a pulley, and/or an eccentric, whether a modular, removable part, or an integral part of a cam assembly, for use with an archery bow.

The bowstring 101 with which the bowstring weight 10 of the current embodiment can be used can come in a variety of forms it be constructed of different materials. In some cases, the bowstring can include servings that are wrapped around elongated strands of the bowstring to provide protection to the strings themselves where they engage other components of the bow, for example, the cams. It is noted that the term bowstring as used herein can include a bowstring that has multiple strands, which may or may not be twisted, and which may or may not be covered by a serving. With reference to FIG. 2, the bowstring 101 can include a bowstring diameter 101D. The bowstring diameter can range from 0.075 inches to 0.12 inches. The bowstring also can include a length L spanning between the first cam 105 and second cam 106. As mentioned above, each of the respective weights can be placed in the upper and lower quarters or thirds of the length L. Of course, in other embodiments, the weights can be placed closer than shown in FIG. 1 to the respective cams. Further, with different cam designs, the weights can be placed farther or closer to those cams.

Turning now to FIGS. 2-3, the bowstring weight 10 can include a first body 20 and a second body 30. The first body 20 can be in the form of a sleeve 21. The sleeve can form a continuous ring or circle around the bowstring 101 when the weight 10 is secured to the bowstring 101. This sleeve 21 can be generally tubular and can include an upper surface or end 23 and a lower surface or end 24. These upper and lower ends can be relatively flat and planar as shown in FIGS. 2-3, however in other applications, these ends can be rounded, angled or contoured. Indeed, these ends can be configured to interface with the second body 30 in a particular manner.

The first body 20 can include a first interior surface 25 and a first exterior surface 26. These surfaces can be opposite one another and can be parts of continuous sidewalls that extend around a longitudinal axis LA of the weight 10 and the sleeve 21. The first interior surface and second interior surface can be cylindrical as shown, however, in other embodiments described below, the interior surface and/or exterior surface can include contours, textures, knurling, ribs, ridges, recesses, dimples, bumps or other shapes to modify the connection of the sleeve with the second body 30 or alter the weight or weight distribution of the sleeve about the bowstring.

As shown in FIG. 2, the sleeve 21 can include a first inner body diameter D1 and a first outer body diameter D2. The first inner body diameter D1 can be sized so that the bowstring 101 and at least a portion of the second body 30 can be disposed and sandwiched within the internal bore 27 of the sleeve 20 that extends generally parallel to the longitudinal axis LA. The first inner body diameter D1 can be optionally between 0.1 inches and 0.5 inches, inclusive, between 0.125 inches and 0.4 inches, inclusive, between 0.125 inches and 0.3 inches, inclusive, between 0.125 and 0.25 inches, inclusive, or about 0.125 inches, about 0.1875 inches, or about 0.25 inches. Further optionally, this first inner body diameter D1 can be greater than the diameter 101D of the bowstring. In some cases, the ratio of the bowstring diameter 101D to the first inner body diameter D1 can be less than 1:3, less than 1:2 or less than 1:1.

The first outer body diameter D2 can be greater than the first inner body diameter D1. The first outer body diameter D2 can be optionally 0.125 inches to 0.75 inches, inclusive, 0.125 inches to 0.5 inches, inclusive, 0.25 inches to 0.5 inches inclusive, 0.3 inches to 0.4 inches, inclusive, or 0.375 inches, depending on the application and amount of applied weight.

The sleeve 21 can include a sleeve length SL from the end 23 to the end 24. This sleeve length SL can be optionally 0.1 inches to 1.5 inches, inclusive, 0.1 inches to 1 inch inclusive, 0.1 inch to 0.5 inches inclusive, 0.1 inches to 0.25 inches, inclusive, 0.1 inches to 0.2 inches, inclusive, or about 0.5 inches, depending on the application and the amount of weight to be applied to the bowstring 101 via the bowstring weight 10.

The sleeve 21 and the first body 20 optionally can be constructed from a different material than the second body 30. For example, the first body 20 can be constructed from metal, such as brass, iron, aluminum, magnesium, copper, lead, steel, nickel, and alloy, and or combinations of the foregoing. The sleeve can be layered and can include structures constructed from different metals depending on the application. On the other hand, the second body 30 can be constructed from a different material than the first body 20. For example, the second body can be constructed from a polymeric material, which also optionally is elastomeric. Some suitable materials for the second body can include natural or synthetic rubber, silicone, thermoplastic polyurethane, polybutadiene, neoprene and mixtures of the same. In some cases, the second body 30 can have a hardness of optionally 20-100 Shore A, inclusive, 25-90 Shore A, inclusive, or 25-70 Shore A inclusive, depending on the application and the amount of movement suitable for the sleeve 21 relative to the bowstring and the second body.

Returning to the first body 20, and in particular the sleeve 21, that sleeve can include can behave a particular way. For example, the weight can be suitable to provide a desired effect on the bowstring as the bowstring is shot. In some cases, the weight can be precisely matched to the design of the cam to enhance the speed and efficiency of the bow. As illustrated, the weight of the sleeve 21 can be optionally 5 grains to 100 grains, inclusive, 7.5 grains to 90 grains, inclusive, 7.5 grains to 70 grains, inclusive, 10 grains to 60 grains inclusive, 10 grains to 50 grains, inclusive, 20 grains to 40 grains, inclusive, 25 grains to 35 grains, inclusive, or about 30 grains, depending on the particular application and amount of weight to be applied to the bowstring 101. Further optionally, the distribution of the weight of the sleeve 21 along the length L of the bowstring 101 can be modified by concentrating weight in a particular portion of the sleeve length SL. For example, near the upper end or surface 23, the sleeve can be of a greater thickness than at or near the lower end or surface 24 of the sleeve.

Figure 4:
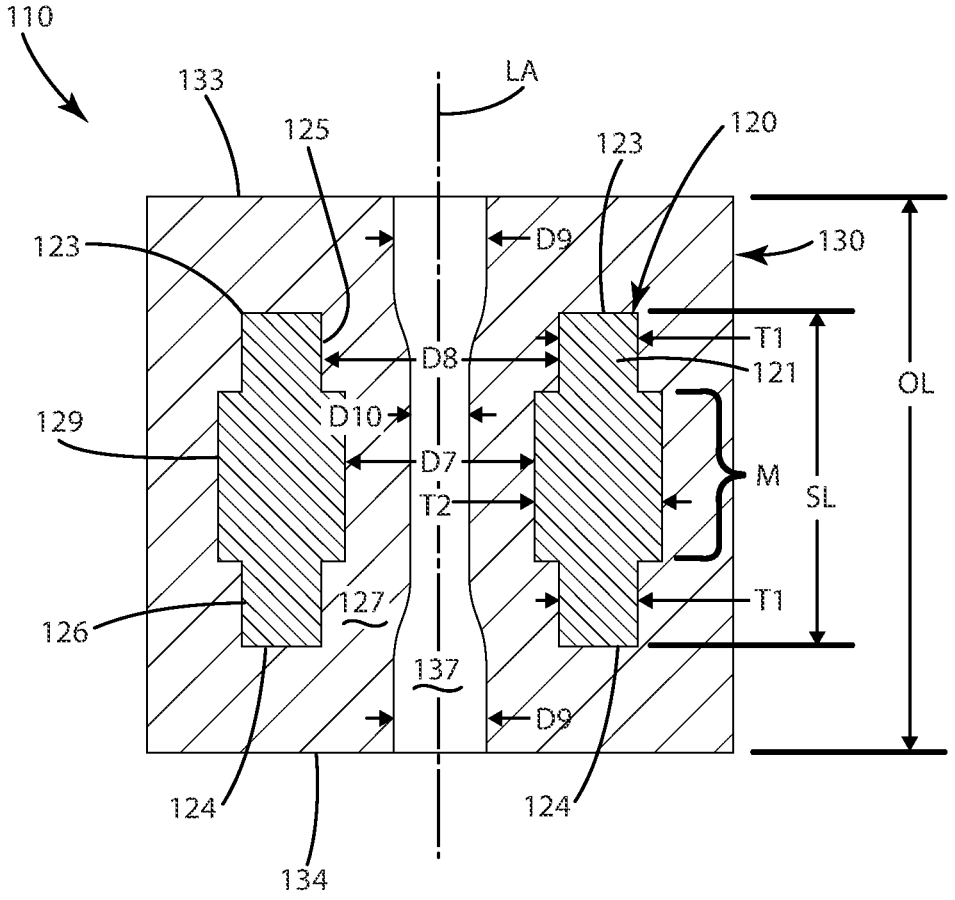
FIG. 4 is a section view of an alternative embodiment of the bowstring weight.

Optionally, the sleeve can be thicker in certain portions along the sleeve length SL. For example, as shown in the alternative embodiment of FIG. 4, the sleeve 121 can include a first thickness T1 adjacent the first surface 123 and second surface lower surface 124. The sleeve however can increase from the first thickness T1 to a greater thickness T2 near the middle portion M of the sleeve length SL. This second thickness T2 can be 1%, 2%, 3%, 4%, 5%, 10%, 20%, 30% or greater than the thickness T1. The greater amount of the weight centered in the middle portion M of the sleeve length SL, and thus the overall length OL of the bowstring weight 110. In this alternative embodiment as well, the first body interior surface 125 and/or first body exterior surface 126 can be contoured. For example, as shown again in FIG. 4, the middle portion am of the sleeve 121 can include the thicker greater thickness T2, while the ends of the bore 127 flare out to a lesser thickness. As a result, that middle portion M can include a diameter D7 within the bore 127 that is less than the diameter D8 that is closer to the upper end or surface 123 and the lower end or surface 124 of the sleeve 121. Further optionally, the first body outer surface 126 can include a stepped shoulder or bumped region 129 that has corresponding greater diameter then the portions of that outer surface at the upper 123 and lower 124 ends or surfaces of the sleeve 121. The other dimensions and weights of the first body 120 and the sleeve 121 this embodiment can be similar to the current embodiment of FIGS. 1-3.

Returning to the embodiment shown in FIGS. 1-3, the second body 30 is joined with the first body 20. In particular, the second body can be a polymeric body that is constructed from a polymer, optionally an elastomeric polymer such as those described above. The second body can be constructed from a polymer such that the first body 20 or sleeve 21 is suspended, encapsulated, and/or embedded within the second body 30. Due to the elastic nature of the second body, the first body 21 can move within the second body and relative to the bowstring 101 when the bowstring moves, oscillates and/or vibrates. For example, as shown in FIG. 2, the first interior surface portion 25A can move in direction N1 toward the bowstring 101 and the longitudinal axis LA, while simultaneously the second interior surface portion 25B can move in direction N2 away from the bowstring 101 and the longitudinal axis LA on an opposite side of the longitudinal axis LA. Further, the first interior surface 25, and reference lines 25R along or parallel to that surface and parallel to the longitudinal axis LA when the bowstring 101 and bowstring weight 10 are static, can change or can be altered in their orientation relative to the longitudinal axis LA via the sleeve 21 moving within the second body 30. For example, in a static configuration, the reference lines 25R that run vertically along the first interior surface 25 can change in angle A1 relative to the longitudinal axis LA when the bowstring 101 transmits vibration and/or oscillations to the bowstring weight 10. The change in angle A1 or other movements N1, N2 of the sleeve within the second body can attenuate and/or reduce the vibration and/or oscillation of the bowstring, as well as the associated noise or "buzz" of the bowstring 101. Optionally, the angle A1 can initially be 0° in a static condition, but with movement of the bowstring 101 caused by oscillation and/or vibration thereof, the angle A1 can change to between 0.1° to 45°, inclusive, between 0.1° and 30°, inclusive or between 0.1° and 10°, inclusive.

As shown in FIG. 2-3, the second body 30 optionally can be polymeric and can be overmolded over the first body 20.

Via its overmolding, the second body can be physically and chemically bonded to the first body such that the first body is substantially encapsulated and embedded within the second body. In some cases, no part of the first body 20 is visible through the second body, with the first body substantially concealed within the second body. Of course, in cases where the first body 20 is partially overmolded by the second body 30, a remaining portion of the first body can be visible through the second body.

The second body 30 can be overmolded over the first interior surface 25 of the sleeve, as well as the first exterior surface 26 of the sleeve 21. The second body 30 and its material can be bonded to those surfaces. The second body 30 can be overmolded and bonded to the upper surface 23 and lower surface 24 of the sleeve and can at least partially fill a portion of the bore 27 of the sleeve. In some cases, the second body can fill at least 10%, at least 20%, at least 25%, or at least 30%, but less than 100%, of the bore 27 of the sleeve 21. The second body however, defines its own bore 37 that is within the bore 27 of the sleeve 21. This bore 37 can include a second inner body diameter D3 that is greater than the bowstring diameter 101D when the bowstring weight 10 is installed on the bowstring 101, but that is less than the bowstring diameter 101D when the bowstring weight 10 is not installed on the bowstring 101. This change in the diameter D3, and thus the overall size cross section of the bore 37 can be attributed to the stretching and/or enlargement of the diameter D3 when the second body 30 is placed on the bowstring 101. Optionally, in a neutral state, when the bowstring weight 10 is not installed on a bowstring 101, the second inner body diameter can be optionally 0.05 inches to 0.2 inches, inclusive, 0.1 inches to 0.2 inches, inclusive or about 0.1 inches, depending on the diameter 101D of the bowstring to which the weight 10 is to be attached. In a stretched state, when the bowstring weight is installed on the bowstring, the second inner body diameter D3 can increase relative to these dimensions. Due to the optionally elastic nature of the second body, the second body and bowstring weight in general grips the bowstring with friction and holds the bowstring weight at a particular location along the length of the bowstring. In many cases, adhesive is not used to secure the bowstring weight in a particular location along the length of the bowstring, but can be in some applications.

Optionally, the second inner body diameter D3 of the bore 37 can be less than the first inner body diameter D1 as well as the first body outer diameter D2. In some cases, the ratio of D1 to D3 can be optionally less than 1:1, less than 1:2, or less than 2:5, or other values depending on the application. Further optionally, in some embodiments for example shown in FIG. 4, the bore 137 can have a varying internal contour such that the second inner body diameter varies along length OL of the second body 130 and weight 110. There, the bore 137 has a diameter D9 near the lower wall 134 and a similar diameter D9 near the upper wall 133 of the second body 130. The bore 137 has a narrowed diameter or lesser diameter D10 between those walls, corresponding to the middle portion M of the sleeve 121. Thus, the cross section of the bore 137 can vary and might not be constant along the longitudinal axis LA of the bowstring weight 110 of this embodiment. With this configuration and its varying diameters of the bore 137 can have an hourglass shape cross-section taken along a plane passing through longitudinal axis of the second body or the weight itself. With this hourglass configuration, the bowstring weight 110 can grip the bowstring to hold the bowstring weight in a particular location, without adhesive, along the bowstring, yet still allow the sleeve and bowstring weight in general to oscillate and move slightly to attenuate vibration and string noise.

With reference to the embodiment in FIGS. 2 and 3, the second body 30 can include an interior wall 35 and exterior wall 36. The interior wall 35 can extend adjacent the first interior surface 25, while the exterior wall 36 can extend adjacent the first exterior surface 26. The inner wall and exterior wall can be joined and bonded directly to these surfaces. The inner wall 25 can optionally completely circumferentiate the bore 37 and can form an inner sleeve 31 within the sleeve 21. This inner sleeve 31 and the inner wall 25 can be sandwiched between the bowstring and the first interior surface 25 of the sleeve 21 and the sleeve itself. Optionally, the bowstring weight 10 can be configured so that the inner wall and inner sleeve 31 directly engage and contact the bowstring 101 when installed on the bowstring, but where the first interior surface 25 and the sleeve 21 do not contact or directly engage the bowstring when weight 10 is installed on the bowstring.

The interior wall 25 and the exterior wall 26 can be connected to one another to form an integrally formed single piece unit that covers the first body 20, optionally encapsulating and suspending the first body within the second body 30. The second body 30 can include an upper wall 33 that extends over and covers the first upper surface or end 23 of the sleeve 21. The second body can include a lower wall 34 that extends over and covers the first lower surface 24 of the sleeve 21. The upper wall 33 can extend a distance D5 above the upper surface or end 23, and the lower wall 34 can extend a distance D6 below the lower surface 24 of the sleeve. Optionally, these distances D5 and D6 can be equal, and greater than the diameter D3 of the bore 37 of the second body 30, and less than the diameter D2 of the sleeve in some cases.

The bowstring weight 10 of the current embodiment, as well as the alternative embodiment bowstring 110 can be installed on an archery bowstring to dampen vibration of the bowstring and reduce string oscillation and noise. A method of installing the bowstring weight 10 generally can include providing an archery bow comprising a first limb and a second limb, with a bowstring having a bowstring diameter located between the first limb and the second limb; providing a bowstring weight comprising a sleeve encapsulated within an overmolded polymeric body; and installing the bowstring weight on the bowstring so that the polymeric body directly engages the bowstring, with the sleeve suspended around the bowstring but separated from the bowstring by an interior wall of the polymeric body.

Optionally, the archery bow can be any of the types of bows described herein. In one example, the archery bow can be a compound archery bow 100 as shown in FIG. 1. The archery bow can be fitted in a bow press to relieve the tension in the bowstring 101. The bowstring can be removed from one or both cams 105 and 106. An end of the bowstring can be pulled or otherwise inserted through the bore 37 of the second body 30. As the bowstring is pulled through that bore 37 it also passes through the bore 27 of the sleeve, and can compress the inner sleeve 31 and inner wall 35 between the bowstring 101 and the interior surface 25 of the sleeve. As the bowstring enters and passes through the bore 37, the diameter D3 of the bore can expand or increase, and can grip the bowstring 101 with friction. One or more additional bowstring weights can be added to the bowstring by installing them on the bowstring in a similar manner and pulling the bowstring through the bore 37 until they are placed along the bowstring length L and a suitable location.

When the bowstring weight 10 is installed on the bowstring 101, the sleeve 21 can circumferentiate the bowstring, with the inner sleeve 31 and inner wall disposed between the sleeve and the bowstring. Optionally the sleeve does not directly contact the bowstring but is disposed a thickness of the inner sleeve 31 of the second body away from that bowstring.

With one or more bowstring weights 10 installed along the length of the bowstring 101, the bowstring can be used. For example, the bow 100 can be drawn with an arrow knocked to the bowstring 101. The user can release the bowstring 101 and propel the arrow. Upon release and/or disengagement of the arrow from the bowstring 101, the bowstring typically will vibrate and oscillate. With the embodiments of the bowstring weights joined with the bowstring, however, these weights dampen vibration of the bowstring and reduce oscillation, as well as attenuate string noise or "buzz" of the bowstring. The sleeve 21 can move within the second body 30 as described above, changing the distance between certain portions of the sleeve and angles of the sleeve relative to the bowstring via the sleeve or first body oscillating, moving or otherwise changing its orientation within the structure of the second body. This also causes the sleeve or first body to oscillate, move or otherwise change its orientation relative to the bowstring 101. In so doing, the first body 20 and/or the sleeve 21 can counter and/or work against oscillation and vibration of the bowstring itself, optionally attenuating or canceling the same to reduce the overall vibration, oscillation and/or noise associated with the bowstring.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to," or "directly coupled to" another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, any combination of X, Y and Z, for example, X, Y, Z; X, Y; X, Z; Y, Z, and/or any other possible combination together or alone of those elements, noting that the same is open ended and can include other elements.

What is claimed is:

1. An archery bowstring weight for placement on a bowstring having a bowstring diameter strung between first and second limbs of an archery bow, the bowstring weight comprising:

a metal body including a first inner body diameter that is greater than a bowstring diameter of a bowstring, on which the bowstring weight is adapted to be placed, the metal body including a first interior surface and a first exterior surface, the metal body configured to at least partially surround the bowstring when placed thereon; and a polymeric body that is overmolded over the metal body first interior surface and the first exterior surface, the polymeric body including a second inner body diameter that is greater than the bowstring diameter and less than the first inner body diameter, wherein the metal body is suspended in the polymeric body, whereby the metal body moves inside the polymeric body when the bowstring vibrates to reduce at least one of vibration and oscillation of the bowstring.

2. The bowstring weight of claim 1, wherein the polymeric body includes an interior wall and an exterior wall, wherein the interior wall extends adjacent the first interior surface, wherein the exterior wall extends adjacent the first exterior surface.

3. The bowstring weight of claim 2, wherein the interior wall and the exterior wall are connected to one another to form an integrally formed single piece unit that covers the metal body.

4. The bowstring weight of claim 1, wherein the metal body includes a first upper surface and a first lower surface, wherein the polymeric body includes an upper wall that extends over and covers the first upper surface, wherein the polymeric body includes a lower wall that extends over and covers the first lower surface.

5. The bowstring weight of claim 4, wherein the polymeric body includes an interior wall and an exterior wall, wherein the interior wall is integral with the upper wall and the lower wall, wherein the exterior wall is integral with the upper wall and the lower wall to encapsulate the metal body within the polymeric body.

6. The bowstring weight of claim 1, wherein the second inner body diameter varies along a length of the polymeric body.

7. The bowstring weight of claim 1, wherein the polymeric body includes a second interior surface at the second inner body diameter, wherein the second interior surface has an hourglass shape in a cross section taken along a plane passing through a longitudinal axis of the polymeric body.

8. The bowstring weight of claim 1, wherein the metal body is constructed of brass, wherein the polymeric body is constructed from rubber that is overmolded over the metal body.

9. The bowstring weight of claim 1, wherein the metal body is tubular and weighs between 5 grains and 100 grains, inclusive.

10. The bowstring weight of claim 1, wherein the first inner body diameter is between 0.125 inches and 0.3 inches, inclusive, wherein the second inner body diameter is less than 0.125 inches.

11. An archery bowstring weight for placement on a bowstring, having a bowstring diameter, strung between first and second limbs of an archery bow, the bowstring weight comprising:

a first body in the form of a sleeve including a first inner body diameter that is greater than a bowstring diameter of a bowstring, on which the bowstring weight is adapted to be placed and to fully circumferentiate; and a second body that encapsulates the sleeve such that the first body is suspended in the second body, wherein the first body floats inside the second body when the bowstring vibrates to at least one of dampen vibration and reduce oscillation of the bowstring.

12. The bowstring weight of claim 11, wherein the sleeve forms a continuous ring around the bowstring when the bowstring weight is applied to the bowstring.

13. The bowstring weight of claim 11, wherein the second body is a polymeric body includes an interior wall that is disposed between the sleeve and the bowstring so that the sleeve does not directly engage the bowstring, but the interior wall of the polymeric body does directly engage the bowstring.

14. The bowstring weight of claim 13, wherein the sleeve is constructed from metal, wherein the sleeve weighs between 5 grains and 100 grains, inclusive, wherein the first inner body diameter is between 0.125 inches and 0.5 inches, inclusive.

15. The bowstring weight of claim 11, wherein the second body includes a second inner body diameter that is greater than the bowstring diameter and less than the first inner body diameter.

16. The bowstring weight of claim 15, wherein the second inner body diameter is less than 0.2 inches.

17. A method comprising:

providing an archery bow comprising a first limb and a second limb, with a bowstring having a bowstring diameter located between the first limb and the second limb;

providing a bowstring weight comprising a sleeve encapsulated within a polymeric body; and installing the bowstring weight on the bowstring so that the polymeric body directly engages the bowstring, with the sleeve suspended around the bowstring but separated from the bowstring by an interior wall of the polymeric body.

18. The method of claim 17, wherein the sleeve is metal and floats inside the polymeric body when the bowstring vibrates to at least one of dampen vibration and attenuate oscillation of the bowstring.

19. The method of claim 17, comprising:

providing the sleeve with a first inner diameter, providing the polymeric body with a second inner diameter, wherein the first inner diameter is greater than the second inner diameter which is greater than the bowstring diameter.

20. The method of claim 19, wherein the sleeve weighs between 5 grains and 100 grains, inclusive, wherein the first inner diameter is between 0.125 inches and 0.5 inches, inclusive.

* * * * *